US006041522A

United States Patent [19]

Anteby

[11] Patent Number: 6,041,522

[45] Date of Patent: Mar. 28, 2000

[54] SHOE STRUCTURE WITH MIDSOLE CHANNEL BETWEEN METATARSAL AND HEEL BULGES

[75] Inventor: Edward J. Anteby, Long Branch, N.J.

[73] Assignee: E.S. Originals, Inc., New York, N.Y.

[21] Appl. No.: 09/320,183

[22] Filed: May 26, 1999

[51] Int. Cl.[7] ..... A43B 13/18

[52] U.S. Cl. ..... 36/29; 36/30 R; 36/103

[58] Field of Search ..... 36/29, 3 B, 25 R, 36/30 R, 32 R, 103

[56] References Cited

U.S. PATENT DOCUMENTS

| | | | |
|---|---|---|---|
| Re. 34,102 | 10/1992 | Cole et al. | 36/102 |
| 4,016,662 | 4/1977 | Thompon | 36/29 |
| 4,237,625 | 12/1980 | Cole et al. | 36/28 |
| 4,262,433 | 4/1981 | Hagg et al. | 36/25 R |
| 4,358,902 | 11/1982 | Cole et al. | 36/28 |
| 4,389,798 | 6/1983 | Tilles | 36/129 |
| 4,414,760 | 11/1983 | Faiella | 36/29 |
| 4,446,634 | 5/1984 | Johnson et al. | 36/29 |
| 4,449,307 | 5/1984 | Stubblefield | 36/32 R |
| 4,458,430 | 7/1984 | Peterson | 36/28 |
| 4,577,417 | 3/1986 | Cole | 36/29 |
| 4,856,208 | 8/1989 | Zaccaro | 36/29 |
| 4,936,030 | 6/1990 | Rennex | 36/28 |
| 5,067,255 | 11/1991 | Hutcheson | 36/43 |
| 5,084,987 | 2/1992 | Flemming | 36/28 |
| 5,195,254 | 3/1993 | Tyng | 36/3 R |
| 5,195,257 | 3/1993 | Holcomb et al. | 36/28 |
| 5,245,766 | 9/1993 | Warren | 36/29 |
| 5,313,717 | 5/1994 | Allen et al. | 36/28 |
| 5,325,614 | 7/1994 | Rosen | 36/97 |
| 5,363,570 | 11/1994 | Allen et al. | 36/28 |
| 5,365,678 | 11/1994 | Shibata | 36/29 |
| 5,375,346 | 12/1994 | Cole et al. | 36/29 |
| 5,384,977 | 1/1995 | Chee | 36/28 |
| 5,416,986 | 5/1995 | Cole et al. | 36/29 |
| 5,524,364 | 6/1996 | Cole et al. | 36/29 |
| 5,545,463 | 8/1996 | Schmidt et al. | 36/29 X |
| 5,664,341 | 9/1997 | Schmidt et al. | 36/28 |
| 5,678,328 | 10/1997 | Schmidt et al. | 36/29 |
| 5,679,439 | 10/1997 | Schmidt et al. | 36/29 X |
| 5,701,687 | 12/1997 | Schmidt et al. | 36/29 |
| 5,706,589 | 1/1998 | Marc | 36/27 |
| 5,771,606 | 6/1998 | Litchfield et al. | 36/29 |
| 5,794,359 | 8/1998 | Jenkins et al. | 36/28 |
| 5,842,291 | 12/1998 | Schmidt et al. | 36/29 |
| 5,896,681 | 4/1999 | Lin | 36/29 X |
| 5,926,974 | 7/1999 | Friton | 36/29 X |

*Primary Examiner*—M. D. Patterson
*Attorney, Agent, or Firm*—Kirschstein, et al.

[57] ABSTRACT

A midsole channel is formed solely in a midsole and enables free air flow between metatarsal and heel cavities formed in an outsole of a shoe structure.

1 Claim, 1 Drawing Sheet

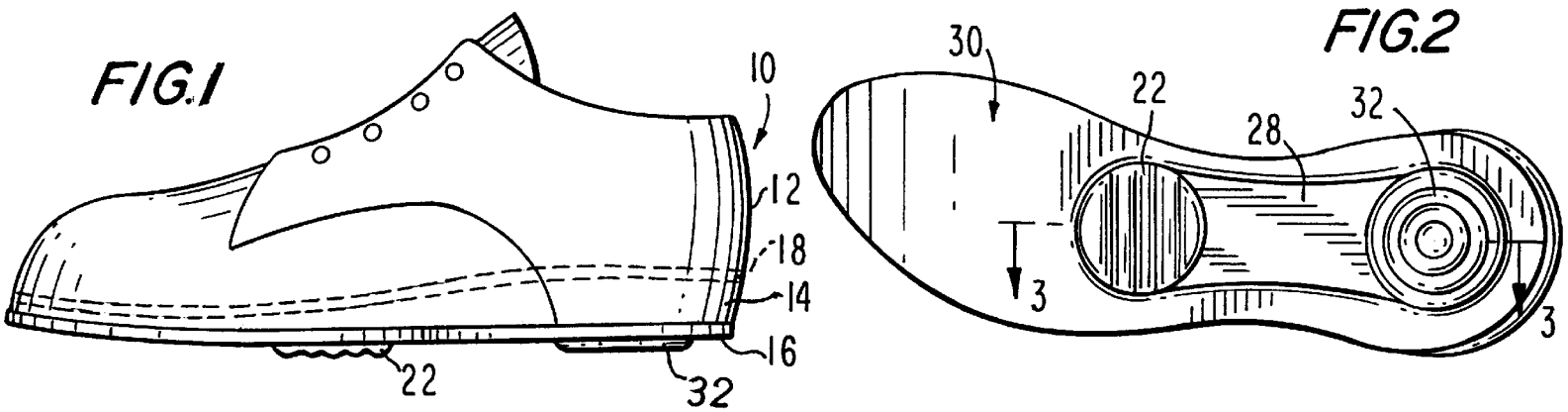
FIG.1
FIG.2
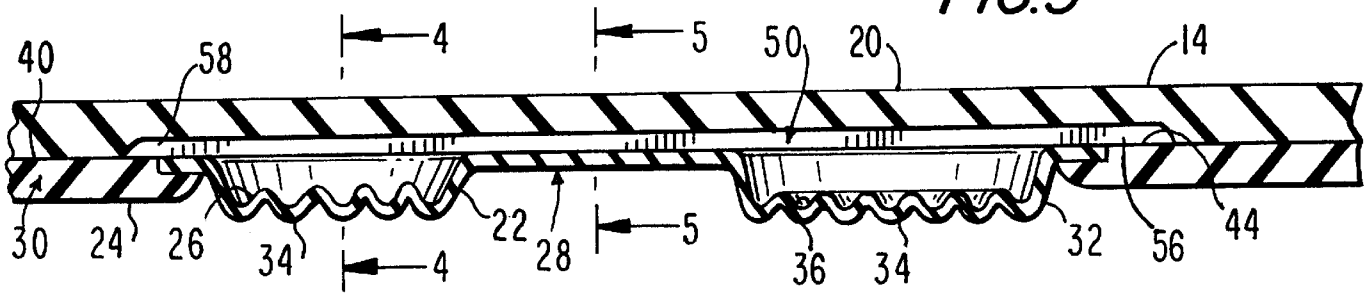
FIG.3
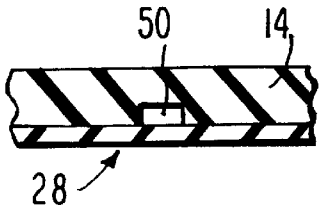
FIG.5
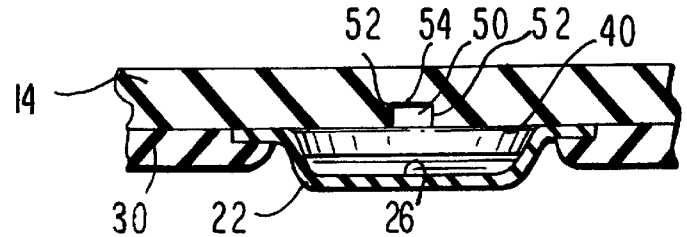
FIG.4

SHOE STRUCTURE WITH MIDSOLE CHANNEL BETWEEN METATARSAL AND HEEL BULGES

BACKGROUND OF THE INVENTION

1. Field of the Invention

The present investigation generally relates to shoe sole and heel structures having fluid-containing cavities for providing a cushioning effect for a wearer's feet, and for assisting the wearer during walking or running by providing thrust which facilitates such motion.

2. Description of the Related Art

It is known, for example, from U.S. Pat. No. 4,237,625, U.S. Pat. No. 4,577,417 and U.S. Pat. No. 5,524,364 to provide a shoe structure having a resilient outsole with metatarsal and heel bulges bounding air-filled cavities, and a restricted passageway formed in the outsole and extending between the cavities. Air moves back and forth between the cavities along the restricted passageway. The known shoe structures provide a measure of cushioning for the wearer's feet, and also provide a forward thrust to help propel the wearer during walking and running. Other shoe constructions, such as exemplified by U.S. Pat. No. 4,016,662, U.S. Pat. No. 5,701,687, U.S. Pat. No. 5,706,589 and U.S. Pat. No. 5,771,606, disclose the use of air bladders within the shoes to provide such cushioning and thrust.

As advantageous as these known shoe structures have been, experience has shown that the restricted passageway becomes at least partially obstructed during walking and running movement, thereby compromising the free flow of air between the cavities. As the resilient outsole is flexed, twisted and otherwise deformed during movement, the passageway, which is molded into the outsole, likewise participates in this deformation, with the result that there are times when creases in the outsole extend across the passageway and impede air flow therealong. This degrades the generation of forward thrust.

SUMMARY OF THE INVENTION

Objects of the Invention

Accordingly, it is a general object of this invention to provide an improved shoe sole structure which avoids the drawbacks of the known constructions.

More particularly, it is an object of the present invention to improve the air flow between the cavities in such shoe constructions.

Still another object of the present invention is to provide a shoe sole structure which is durable in construction and inexpensive to manufacture, and which affords additional advantages over the known shoe sole constructions.

Features of the Invention

In keeping with the above objects and others which will become apparent hereinafter, one feature of the present invention resides, briefly stated, in a structure for a shoe. The structure includes an outsole having interior and exterior surfaces. The outsole has a resilient, metatarsal bulge projecting outwardly from the exterior surface and bounding a metatarsal cavity underlying a metatarsal ball area of a foot of a wearer of the shoe. The outsole also has a resilient heel bulge projecting outwardly from the exterior surface and bounding a heel cavity underlying a heel area of the foot.

The structure also includes a midsole having an inner face. The midsole overlies the cavities and is sealed in a leak-resistant manner to the interior surface of the outsole to seal fluid within the cavities.

In accordance with this invention, a midsole channel is formed solely in the midsole. The channel opens onto the inner face of the midsole. The midsole channel overlies the interior surface of the outsole to bound an elongated passageway therewith. The passageway has opposite ends in constantly-open communication with the respective cavities. The passageway extends between the cavities for enabling the fluid to flow along the passageway between the cavities.

Thus, by forming the channel in the midsole, as opposed to forming the channel in the outsole, the channel is located further away from the outsole and the bulges where the bulges and the outsole are subjected to external pressure forces. The channel is more isolated from the deformation present at the outsole and is less likely to collapse, thereby enabling the air within the cavities to flow freely along the channel.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a side elevational view of a shoe incorporating a structure in accordance with this invention;

FIG. 2 is a bottom plan view of the structure of FIG. 1;

FIG. 3 is a broken-away, enlarged sectional view taken on line 3—3 of FIG. 2;

FIG. 4 is a broken-away, enlarged sectional view taken on line 4—4 of FIG. 3; and FIG. 5 is a broken-away, enlarged sectional view taken on line 5—5 of FIG. 3.

DETAILED DESCRIPTION OF THE PREFERRED EMBODIMENT

Referring now to FIG. 1, reference numeral 10 generally identifies a shoe having a conventional upper 12, a midsole 14 and an outsole 16. A conventional insole 18 is adhesively secured to an upper surface 20 of the midsole, and includes a cushioned insert on which a wearer's foot directly makes contact. The insole may consist of one or more resilient layers that extend over the entire length of the shoe.

The outsole 16 is an elongated, molded, resilient member, preferably constituted of rubber, especially formed of a wear-resistant composition. The outsole 16 has a metatarsal bulge 22 projecting outwardly from an exterior surface 24 of the outsole and bounding a metatarsal cavity 26 underlying a metatarsal ball area of a wearer's foot. The outsole 16 also has a heel bulge 32 projecting outwardly from the exterior surface 24 of the outsole and bounding a heel cavity 36 underlying a heel area of the wearer's foot. The bulges 22, 32 have tread patterns 34 to enhance frictional engagement with the ground on which the wearer is supported.

The outsole is preferably constituted of two pieces. An inner piece 28 is centrally located and includes the bulges 22, 32. An outer piece 30 surrounds the inner piece 28. Each piece may be provided with different wear-resistant properties. The pieces are integrally molded together to form a one-piece construction.

The midsole 14 has a lower or inner face 40 which is opposite to the upper surface 20. The inner face 40 overlies the cavities 26, 36 and is sealed in a leak-resistant manner, e.g., by an adhesive, to an interior surface 44 of the outsole.

A midsole channel 50 is molded and formed solely in the midsole 14. The channel 50 has side walls 52 and a base wall 54 and is open downwardly. The channel 50 overlies the interior surface 44 of the outsole and bounds therewith an elongated passageway. The channel 50 has one end region 56 in communication with the heel cavity 36, an opposite end region 58 in communication with the bulge cavity 26, and extends lengthwise of the outsole between the cavities for enabling fluid, especially air at atmospheric pressure contained in the cavities, to flow along the passageway between the cavities. The inner face 40 of the midsole 14 is adhesively bonded to the interior surface 44 of the outsole to insure that no fluid can leak out of the cavities and the passageway to the exterior of the shoe.

In use, the bulges 22, 32 both contact the ground while the wearer is standing. Air within the cavities 26, 36 inflate the bulges and provide cushioning so that the wearer is supported on these air-filled bulges. When walking or running, when the heel bulge 32 solely engages the ground, the weight of the wearer pushes the air out of the heel bulge and forces the air under pressure through the passageway to the metatarsal bulge 22. As the heel bulge leaves the ground, and the metatarsal bulge engages the ground, the air in the metatarsal cavity 26 is forced under pressure back through the passageway to the heel cavity 36 and provides a lifting or forward thrust to assist the advancement of the wearer. During such movement, the air moves back and forth between the cavities 26, 36 through the passageway. The filling of each cavity imparts a lifting action.

The passageway is never closed or obstructed due to its relatively high elevation above the ground and its formation in the midsole above the outsole. Deformation or flexing of the outsole during walking and running is not transmitted to the passageway, or at least is highly attenuated before reaching the passageway.

Although air at atmospheric pressure is the preferred medium within the cavities and the passageway, other fluids and other pressures are contemplated by this invention.

It will be understood that each of the elements described above, or two or more together, also may find a useful application in other types of constructions differing from the types described above.

While the invention has been illustrated and described as embodied in a shoe sole structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. In an improved structure for a shoe, including

A) an outsole having interior and exterior surfaces, the outsole having a resilient, metatarsal bulge projecting outwardly from the exterior surface and bounding a metatarsal cavity underlying a metatarsal ball area of a foot of a wearer of the shoe, the outsole having a resilient, heel bulge projecting outwardly from the exterior surface and bounding a heel cavity underlying a heel area of the foot;

B) a midsole having a periphery and an inner face overlying the cavities and sealed in a leak-resistant manner to the interior surface of the outsole to seal fluid within the cavities; and C) a midsole channel opening onto the inner face of the midsole, the midsole channel overlying the interior surface of the outsole to bound an elongated passageway therewith, the passageway having opposite ends in constantly-open communication with the respective cavities, the passageway extending between the cavities for enabling the fluid to flow along the passageway between the cavities, wherein the improvement comprises:

i) the metatarsal bulge being one in number;

ii) the heel bulge being one in number;

iii) the midsole channel being formed solely in the midsole and extending as a single groove entirely across the metatarsal cavity and the heel cavity; and iv) the midsole channel being spaced entirely within the periphery of the midsole to permanently seal the fluid within the cavities.

* * * * *